US009244417B2

(12) United States Patent
Tanaka et al.

(10) Patent No.: US 9,244,417 B2
(45) Date of Patent: Jan. 26, 2016

(54) IMAGE FORMING APPARATUS

(71) Applicants: Mizuna Tanaka, Osaka (JP); Yuuki Shiga, Hyogo (JP); Kimihiro Tanaka, Osaka (JP); Toshikane Nishii, Osaka (JP); Akimitsu Obana, Hyogo (JP)

(72) Inventors: Mizuna Tanaka, Osaka (JP); Yuuki Shiga, Hyogo (JP); Kimihiro Tanaka, Osaka (JP); Toshikane Nishii, Osaka (JP); Akimitsu Obana, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/557,344

(22) Filed: Dec. 1, 2014

(65) Prior Publication Data

US 2015/0153686 A1 Jun. 4, 2015

(30) Foreign Application Priority Data

Dec. 3, 2013 (JP) ..... 2013-250142

(51) Int. Cl.
*G03G 15/00* (2006.01)

(52) U.S. Cl.
CPC .... *G03G 15/5058* (2013.01); *G03G 2215/0132* (2013.01); *G03G 2215/0158* (2013.01); *G03G 2215/0161* (2013.01)

(58) Field of Classification Search
CPC ..... G03G 15/5058
USPC ..... 399/49
See application file for complete search history.

(56) References Cited

U.S. PATENT DOCUMENTS

| | | | |
|---|---|---|---|
| 2005/0238388 | A1 | 10/2005 | Tanaka |
| 2008/0226358 | A1 | 9/2008 | Hanashima et al. |
| 2009/0238585 | A1 | 9/2009 | Hayashi et al. |
| 2009/0245822 | A1 | 10/2009 | Nagatsuka et al. |
| 2009/0302521 | A1 | 12/2009 | Kondo et al. |
| 2013/0322909 | A1 | 12/2013 | Shiga |
| 2013/0322910 | A1 | 12/2013 | Shiga et al. |
| 2014/0119777 | A1 | 5/2014 | Fujimoto et al. |
| 2014/0233979 | A1 | 8/2014 | Namba et al. |

FOREIGN PATENT DOCUMENTS

| | | |
|---|---|---|
| JP | 2006-293240 | 10/2006 |
| JP | 2009-036993 | 2/2009 |
| JP | 2011-164513 | 8/2011 |
| JP | 2012-123048 | 6/2012 |

*Primary Examiner* — Walter L Lindsay, Jr.
*Assistant Examiner* — Ruth Labombard
(74) *Attorney, Agent, or Firm* — Duft Bornsen & Fettig LLP

(57) ABSTRACT

An image forming apparatus includes an image bearer, an image forming unit, an intermediate transfer member, a secondary transfer member, an image detector, a computing device, and a conveyor device. The computing device calculates a traveling speed of the intermediate transfer member based on detection information provided by the image detector. The conveyor device continuously transports to a secondary transfer portion a plurality of recording media one by one at a predetermined interval between successive recording media. The image forming unit forms a test image at a space between successive recording-medium contact regions of the intermediate transfer member at which the recording medium contacts the intermediate transfer member. A travel distance of the intermediate transfer member from the detection position on the intermediate transfer member to the secondary transfer portion in a traveling direction thereof is shorter than the space between the successive recording-medium contact regions.

14 Claims, 9 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2013-250142, filed on Dec. 3, 2013, in the Japan Patent Office, the entire disclosure of which is hereby incorporated by reference herein.

BACKGROUND

1. Technical Field

Exemplary aspects of the present invention generally relate to an image forming apparatus, such as a copier, a facsimile machine, a printer, or a multifunction peripheral including a combination thereof.

2. Description of the Related Art

There is known an image forming apparatus using an indirect transfer method in which an image on a photoconductor is transferred onto a recording medium via an intermediate transfer member such as an intermediate transfer belt formed into an endless loop. In the image forming apparatus using the indirect transfer method, when a trailing edge of the recording medium exits a secondary transfer portion at which the image on the intermediate transfer member is transferred onto the recording medium sudden stress is applied to the intermediate transfer member, which results in changes in the traveling speed of the intermediate transfer member. Due to changes in the traveling speed of the intermediate transfer member, an image transfer failure, a so-called shock jitter, occurs at a primary transfer portion at which the image on the photoconductor is transferred onto the intermediate transfer member.

SUMMARY

In view of the foregoing, in an aspect of this disclosure, there is provided an improved image forming apparatus including an image bearer, an image forming unit, an intermediate transfer member, a secondary transfer member, an image detector, a computing device, and a conveyor device. The image bearer bears an image on a surface thereof. The image forming unit forms the image including a test image on the image bearer. The intermediate transfer member is formed into an endless loop and disposed opposite the image bearer at a primary transfer portion at which the image is transferred from the image bearer onto the intermediate transfer member. The intermediate transfer member travels in a traveling direction. The secondary transfer member contacts the intermediate transfer member at a secondary transfer portion to transfer secondarily the image from the intermediate transfer member onto a recording medium. The image detector detects at a detection position a test image on the intermediate transfer member between the primary transfer portion and the secondary transfer portion in the traveling direction. The computing device calculates a traveling speed of the intermediate transfer member based on detection information provided by the image detector. The conveyor device continuously transports to the secondary transfer portion a plurality of recording media one by one at a predetermined interval between successive recording media. The image forming unit forms the test image at a space between successive recording-medium contact regions of the intermediate transfer member at which the recording medium contacts the intermediate transfer member. A travel distance of the intermediate transfer member from the detection position on the intermediate transfer member to the secondary transfer portion in the traveling direction is shorter than the space between the successive recording-medium contact regions.

According to another aspect, an image forming apparatus includes a belt, a transfer device, and a test image detector. The belt bears an image on a surface thereof. The transfer device transfers the image from the belt onto a recording medium at a transfer portion. The test image detector detects at a detection position a test image formed at a space between successive recording media on the belt. A distance on the belt from the detection position to the transfer portion is shorter than the space between successive recording media on the belt.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
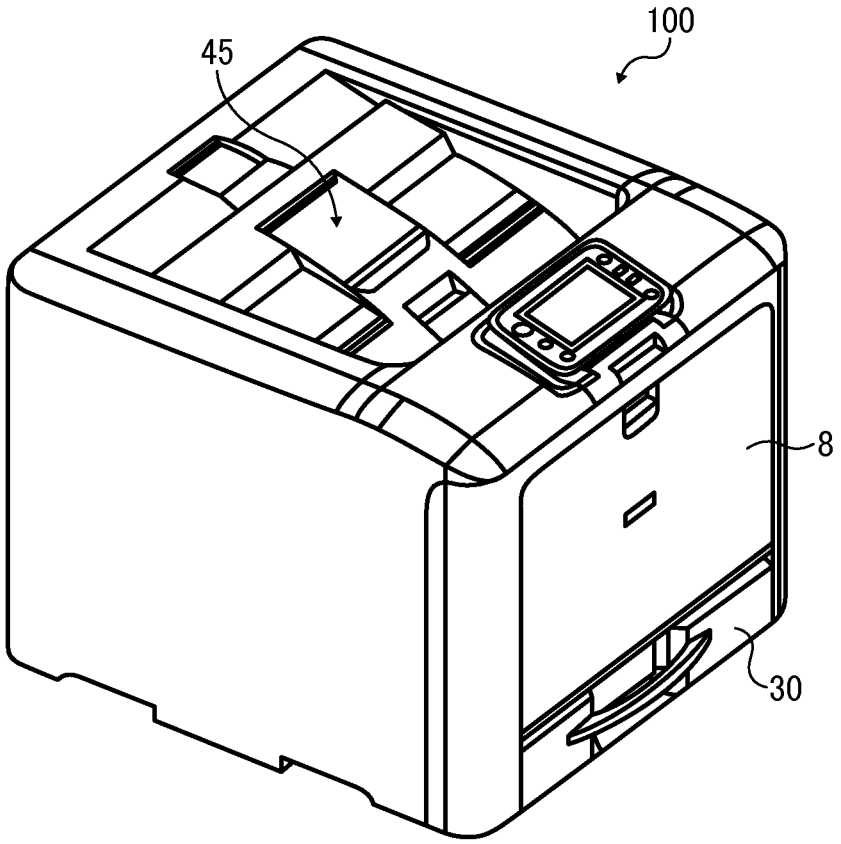
FIG. 1 is a perspective view schematically illustrating a color laser printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

It is to be noted that an "image forming apparatus" herein refers to an apparatus that forms an image on media including, but not limited to, paper, an OHP sheet, a thread, a fiber, a cloth, leather, metal, plastic, glass, wood, and ceramic, using a development agent adhered to the media. Image formation herein refers to forming on a medium an image including, but not limited to characters, graphics, and patterns. According to the an illustrative embodiment, a sheet-type medium is referred to as a recording medium, and a size, material, shape, and relative position are shown as examples, and are not limited to thereto.

Figure 2:
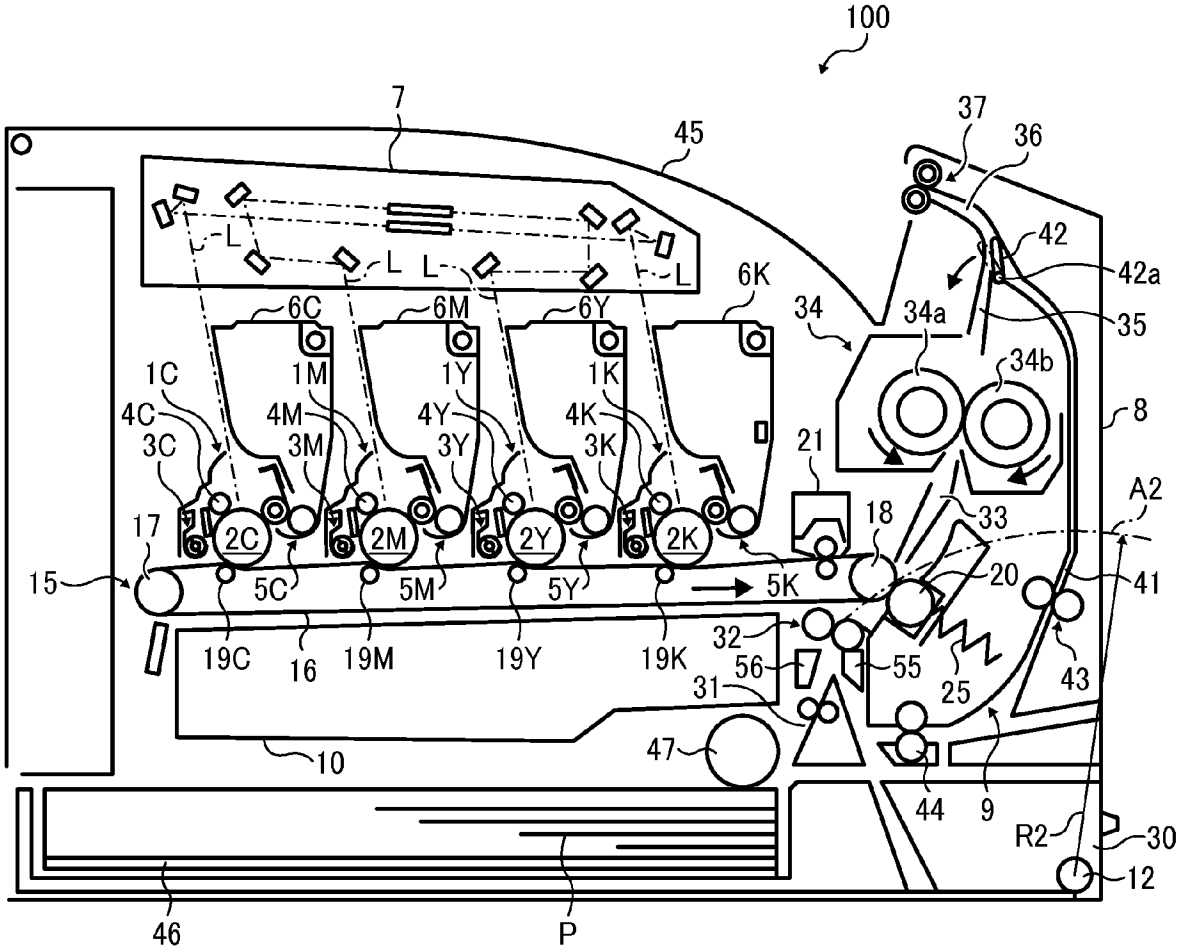
FIG. 2 is a cross-sectional view schematically illustrating the image forming apparatus of FIG. 1.

FIGS. 1 and 2 illustrate a tandem-type color laser printer as an example of an image forming apparatus in which a plurality of photoconductors is arranged in tandem, according to an illustrative embodiment of the present disclosure. FIG. 1 is a perspective view schematically illustrating an exterior of an image forming apparatus 100. FIG. 2 is a cross-sectional view schematically illustrating the image forming apparatus 100 of FIG. 1.

As illustrated in FIG. 1, the image forming apparatus 100 includes a paper tray 30, an output tray 45, a cover 8, and so forth. The paper tray 30 is disposed at the bottom of the image forming apparatus 100 and includes a stack of multiple recording media P. The cover 8 is disposed above the paper tray 30. The output tray 45 is disposed at the upper portion of the image forming apparatus 100. The cover 8 is openably rotatable about a rotary shaft 12 disposed substantially at the bottom of the image forming apparatus. The cover 8 can be opened when the cover 8 is rotated about the rotary shaft 12.

As illustrated in FIG. 2, the image forming apparatus 100 includes four process units 1C, 1M, 1Y, and 1K, one for each of the colors cyan (C), magenta (M), yellow (yellow), and black (K), respectively. It is to be noted that the suffixes C, M, Y, and K denote colors cyan, magenta, yellow, and black, respectively. These suffixes are omitted, unless the discrimination of the colors is necessary. The process units 1C, 1M, 1Y, and 1K serve as image forming units. The four process units 1C, 1M, 1Y, and 1K have the same configurations, differing only in the color of toner employed. These process units 1C, 1M, 1Y, and 1K may also be referred to as process units 1.

The process units 1C, 1M, 1Y, and 1K include drum-shaped photoconductors 2C, 2M, 2Y, and 2K, each of which bears an image on the surface thereof. The photoconductors 2C, 2M, 2Y, and 2K may be referred to as the photoconductors 2. The four photoconductors 2 are disposed at predetermined intervals horizontally along an intermediate transfer belt 16 in the image forming apparatus 100. The photoconductors 2 are driven to rotate in a clockwise direction by a drive source.

Each of the photoconductors 2 is surrounded with various imaging devices necessary for electrophotographic imaging such as charging rollers 4C, 4M, 4Y, and 4K (also referred to as charging rollers 4) and developing rollers 5C, 5M, 5Y, 5K (also referred to as developing rollers 5). Each of the charging rollers 4 serves as a charger to charge the surface of the photoconductors 2. Each of the developing rollers 5 serves as a developing device to supply a respective color of toner to the surface of the photoconductors 2 to form a toner image (visible image).

The image forming apparatus 100 includes an exposure device 7 serving as a latent image forming device disposed above the photoconductors 2. The exposure device 7 irradiates the surface of each of the photoconductors 2 charged uniformly by the charging rollers 4 to form an electrostatic latent image on the surface thereof. A relatively long and narrow space is secured between the charging roller 4 and the photoconductor 2 in an axial direction of the photoconductor 2 to allow a laser light L projected from the exposure device 7 to strike the photoconductor 2.

The exposure device 7 is a laser-scan type exposure device using a laser light source, a polygon mirror, and so forth, and projects from four semiconductor lasers of the light source the laser light L modulated in accordance with image data of an image to be output. The exposure device 7 includes a metal or resin body which houses optical parts and parts for control. The upper portion of the exposure device 7 forms a laser light window including a dust proof member. The exposure device 7 shown in FIG. 2 is constituted of a single body. Alternatively, the image forming apparatus may include a plurality of exposure devices for each of the image forming units. Still alternatively, instead of the exposure device using the laser light, an exposure device consisting of a combination of an LED array and an imaging device may be employed.

A toner detector detects an amount of cyan toner, magenta toner, yellow toner, and black toner consumed in the respective developing devices. Toner bottles 6C, 6M, 6Y, and 6K (also referred to as toner bottles 6) serving as a developing agent container store toner in the respective color and supply the developing rollers 5 with the developing agent of the respective color.

Each of the developing rollers 5 includes a cylindrical member made of stainless steel or aluminum. The developing rollers 5 are rotatably supported by a frame such that a certain distance is secured between the photoconductors 2 and the developing rollers 5. The developing rollers 5 include a magnet inside thereof to form a field line. The electrostatic latent images formed on the photoconductors 2 by the laser light L are then developed with toner by the developing rollers 5, thereby forming visible images known as toner images on the photoconductors 2.

A transfer device 15 is disposed below the photoconductors 2. The transfer device 15 includes an intermediate transfer belt 16 formed into an endless loop and entrained around a driven roller 17 at one end and a drive roller 18 at the other end. Rotation of the drive roller 18 causes the intermediate transfer belt 16 to travel in a direction of arrow. The surface of each of the photoconductors 2 after passing through an opposed portion facing the developing roller 5 contacts an upper surface of the intermediate transfer belt 16. Primary transfer rollers 19Y, 19C, 19M, and 19K (also referred to as primary transfer rollers 19) serving as primary transfer devices are disposed inside the looped intermediate transfer belt 16, opposite to the respective photoconductor 2. The toner images on the photoconductors 2 are electrostatically transferred onto the intermediate transfer belt 16 at primary transfer nips (also referred to as primary transfer portions) at which the primary transfer rollers 19 face the intermediate transfer belt 16.

A belt cleaning device 21 is disposed near the right end of the intermediate transfer belt 16, facing the outer peripheral surface of the intermediate transfer belt 16. The belt cleaning device 21 removes toner residues remaining on the surface of the intermediate transfer belt 16 and foreign substances such as paper dust.

The intermediate transfer belt 16 may be formed of a resin film or rubber base having a thickness in a range of from 50 μm to 600 μm. The intermediate transfer belt 16 has such a resistance value that the toner images on the photoconductors 2 are transferred onto the surface of the intermediate transfer belt 16 when a transfer bias is applied to the primary transfer rollers 19. The primary transfer roller 19 includes, for example, a metal cored bar, the surface of which is covered with a conductive rubber material. The transfer bias is applied to the metal cored bar by a power source. The conductive rubber material includes, for example, urethane rubber with carbon dispersed therein and having a volume resistivity of approximately 105 Ωcm. As the primary transfer roller 19, a metal roller without the rubber layer may be employed.

A secondary transfer roller 20 serving as a secondary transfer member is disposed outside the loop of the intermediate transfer belt 16 at a position facing to the drive roller 18 via the intermediate transfer belt 16. The secondary transfer roller 20 includes, for example, a metal cored bar, the surface of which is covered with a conductive rubber material. A secondary transfer bias is applied to the metal cored bar by a power source. The conductive rubber material includes, for example, urethane rubber with carbon dispersed therein and having a volume resistivity of approximately 107 Ωcm.

The secondary transfer roller 20 contacts the intermediate transfer belt 16 at a position opposite to the drive roller 18, thereby forming a secondary transfer nip therebetween. The toner image on the intermediate transfer belt 16 is electrostatically transferred onto a recording medium P carried on the intermediate transfer belt 16 as the bias is applied to the secondary transfer roller 20 while the recording medium P passes through a secondary transfer nip N2 (shown in FIG. 3A) between the intermediate transfer belt 16 and the secondary transfer roller 20.

A powder container 10 storing waste toner is disposed between the intermediate transfer belt 16 and the paper tray 30 below the intermediate transfer belt 16. Excess toner on the intermediate transfer belt 16 is removed by a blade and stored in the powder container 10.

According to the present illustrative embodiment, an empty space is provided between the paper tray 30 and the secondary transfer roller 20 to accommodate paper guides 55 and 56, and a pair of timing rollers 32 in the empty space. Such an empty space between the intermediate transfer belt 16 and the paper tray 30 is used to dispose the powder container 10, thereby making the image forming apparatus as a whole as compact as is usually desired.

The paper tray 30 includes a bottom plate 46 inside thereof to accommodate a stack of recording media P on the bottom plate 46. The left end of the bottom plate 46 is rotatably held by a support shaft, and the right end thereof is pivotally movable up and down vertically. The bottom plate 46 is always biased upward by a spring. At the upper front portion of the paper tray 30 includes a feed roller 47 serving as a conveyor device. The feed roller 47 contacts the top sheet of the stack of recording media P on the bottom plate 46 and sends the top sheet to a conveyance path 31. The feed roller 47 does not have to be a roller as long as it can feed the recording medium P frontward. For example, a looped belt entrained about two rollers may be employed in place of the feed roller 47.

The pair of timing rollers 32 for temporarily stopping the sheet is disposed near the end of the conveyance path 31. The pair of timing rollers 32 is disposed near the intermediate transfer belt 16 at the upstream side in the transport direction of the recording medium P. The pair of timing rollers 32 stops temporarily the recording medium P to make it slack so as to align with the toner image on the intermediate transfer belt 16. Immediately before the toner image formed on the intermediate transfer belt 16 is transferred onto the recording medium P at the secondary transfer nip N2, the pair of timing rollers 32 feeds the recording medium P to the secondary transfer nip at a predetermined timing.

A duplex unit 9 is disposed at a proximal side of the intermediate transfer belt 16 in the image forming apparatus 100 of a full-front operation type such as shown in FIGS. 1 and 2. For this reason, there is not much space at the proximal side of the secondary transfer roller 20 and the pair of timing rollers 32. In view of the above, the secondary transfer roller 20 and the pair of timing rollers 32 are disposed in a slanting direction, thereby saving some space. In particular, a compression spring 25 of the secondary transfer roller 20 is relatively large so that disposing the secondary transfer roller 20 and the pair of timing rollers 32 in the slanting direction can save some space in the image forming apparatus 100 in the front and back directions.

The pair of timing rollers 32 is disposed at the distal side of the image forming apparatus 100 relative to the drive roller 18 of the intermediate transfer belt 16. In this configuration, when one of the timing rollers 32 at the cover 8 side stays at the position shown in FIG. 2 and the cover 8 is opened, a trajectory A2 of the one of timing rollers 32 indicated by a dot-dash line interferes with the drive roller 18. That is, a radius R2 of the trajectory A2 with a rotary shaft 12 of the cover 8 as a center interferes with the drive roller 18. In order to avoid the interference, the timing roller 32 at the cover side is swingably moved inward by a moving device in the radial direction of the trajectory A2 as the cover 8 is being opened.

A post-transfer conveyance path 33 after transfer process is provided above the nip defined by the secondary transfer roller 20 and the drive roller 18. A fixing device 34 as a fixing mechanism is disposed near the end of the post-transfer conveyance path 33. The fixing device 34 includes a fixing roller 34*a* incorporating therein a heat generating source such as a halogen lamp and a pressing roller 34*b* that pressingly contacts the fixing roller 34*a* at a predetermined pressure while being rotated. As a fixing device, a fixing device using an endless looped belt and a fixing device using an IH heating method may be employed.

A post-fixation conveyance path 35 after fixing process is disposed downstream from the fixing device 34 in the transport direction of the recording medium P, that is, at the upper portion of the fixing device 34. The post-fixation conveyance path 35 splits into a sheet output path 36 and a reverse conveyance path 41 at the end of the post-fixation conveyance path 35. A switch member 42 that is pivotally driven on a pivotal shaft 42*a* is disposed on the side of the post-fixation conveyance path 35. A pair of output rollers 37 is disposed at the end of the sheet output path 36.

When the switch member 42 is at a position indicated by a solid line in FIG. 2, the recording medium P after fixing process is guided to the sheet output path 36 and is output or stacked onto the output tray 45 by rotation of the pair of output rollers 37. After the trailing edge of the recording medium P passes by the switch member 42 after completion of the fixing process on one side of the recording medium P, the switch member 42 is rotated in a counterclockwise direction from the position indicated by the solid line and the pair of output rollers 37 is rotated in a reverse direction. Accordingly, the recording medium P is guided to the reverse conveyance path 41 by the switch member 42. The recording medium P is sent to the pair of timing rollers 32 by reverse conveyor roller pairs 43 and 44.

With reference to FIG. 1, a description is provided of a basic operation of the image forming apparatus 100 according to an illustrative embodiment of the present disclosure.

In FIG. 1, as the feed roller 47 of the paper tray 30 is rotated based on a conveyance signal from a controller of the image forming apparatus 100, only the top sheet of the recording media stacked on the bottom plate 46 of the paper tray 30 is separated and fed to the conveyance path 31. When the leading end of the recording medium P reaches a nip of the timing roller pair 32, the recording medium P stands by with slack formed thereat in order to take timing (synchronism) with the toner image to be formed on the intermediate transfer belt 16 and to correct skew at leading end of the recording medium P.

A description is provided of the image forming operation of the process unit 1K as an example of the image forming operation of the process units 1. Initially, the surface of the photoconductor 2K is uniformly charged at a relatively high electrical potential by the charging roller 4K (Negative charging). The surface of the photoconductor 2K is irradiated with a laser beam L by the exposure device 7 based on image data. Then, a potential of the portion irradiated with the laser beam L decreases, thus forming an electrostatic latent image on the surface of the photoconductor 2K. An unused black toner is supplied from the toner bottle 6K to the outer circumferential surface of the developing roller 5K.

The black toner carried on the outer circumferential surface of the developing roller 5K is electrostatically absorbed to the electrostatic latent image on the surface of the photoconductor 2K, thereby developing the electrostatic latent image with toner to form a visible image, known as a toner image. Subsequently, the primary transfer roller 19, which has been charged positive, transfers primarily the toner image from the photoconductor 2K onto the surface of the intermediate transfer belt 16 traveling in synchronism with the photoconductor 2K. Such latent image formation, development, and primary transfer are performed in all the process units 1 in appropriate timing corresponding to image data.

Accordingly, four toner images in cyan, magenta, yellow, and black are transferred onto the surface of the intermediate transfer belt 16 in such a manner that they are superimposed one atop the other, thereby forming a composite toner image on the surface of the intermediate transfer belt 16. The composite toner image is carried on the intermediate transfer belt 16 and moves together in the direction indicated by arrow in FIG. 1.

The drum cleaning device 3K removes toner residues adhering to the photoconductor 2K after the transfer process. The removed toner residues are send to a waste toner container housed inside the process unit 1K by a waste toner conveyor and are collected in the waste toner container. A static eliminator statically eliminates electric charges remaining on the photoconductor 2K after cleaning.

When the toner images are transferred onto the intermediate transfer belt 16 such that they are superimposed one atop the other, thus forming a composite toner image on the surface thereof as described above, the pair of timing rollers 32 and the feed roller 47 start to be driven. Then, the recording medium P is fed to the secondary transfer roller 20 in timing (synchronism) with the composite toner image transferred onto the intermediate transfer belt 16. The secondary transfer roller 20 is charged positive so that the composite toner image formed on the intermediate transfer belt 16 is transferred onto the recording medium P at the secondary transfer nip at which the secondary transfer roller 20 faces the intermediate transfer belt 16. The toner residues are removed from the intermediate transfer belt 16 by the belt cleaning device 21 in preparation for the subsequent imaging and transfer cycle. The toner residues and foreign substance removed from the intermediate transfer belt 16 are transported to the powder container 10 by the waste toner conveyor and collected in the powder container 10.

The recording medium P bearing the composite toner image transferred thereon is delivered to the fixing device 34 via the post-transfer conveyance path 33 after the transfer. The recording medium P that has been fed into the fixing device 34 is interposed between the fixing roller 34*a* and the pressing roller 34*b*, and the toner image on the recording medium P that is not yet fixed is heated and pressed. Accordingly, the unfixed toner image is fixed on the recording medium P. The recording medium P having the composite toner image fixed thereon is fed from the fixing device 34 to the post-fixation conveyance path 35 after fixing process.

The switch member 42 is located at a position indicated by the solid line shown in FIG. 1 at the timing in which the recording medium P is fed from the fixing device 34, and therefore, the post-fixation conveyance path 35 after the fixing process is opened around the end thereof. After the recording medium P fed from the fixing device 34 passes the post-fixation conveyance path 35, the recording medium P is interposed between the pair of output rollers 37, and is output onto the output tray 45 with the surface bearing the image facing down.

A description is now provided of double sided printing of the image forming apparatus 100. In the case of double-sided printing, when the rear end of the recording medium P to be conveyed by the pair of output rollers 37 passes the post-fixation conveyance path 35 after the fixing process, the switch member 42 is pivotally moved to a position indicated by a broken line in FIG. 1, and therefore, the end portion of the post-fixation conveyance path 35 after the fixing process is closed. At substantially the same time, the pair of output rollers 37 is reversely rotated so that the recording medium P is reversely conveyed into the reverse conveyance path 41. The recording medium P conveyed along the reverse conveyance path 41 arrives at the pair of timing rollers 32 via the reverse conveyor roller pairs 43 and 44, and then the recording medium P is fed in appropriate timing such that toner images on the intermediate transfer belt 16 to be formed on the second side of the recording medium P are aligned with the recording medium P.

The image to be formed on the second side of the recording medium P is formed in the imaging process which starts when the recording medium P is delivered to a predetermined position. The image forming process in the double sided printing is similar to the single-side color image forming operation described above. That is, a composite (full color) toner image is borne on the intermediate transfer belt 16. It is to be noted that because the front and the back of the recording medium P is reversed in the conveyance path, the image data projected from the exposure device 7 is controlled or adjusted such that the image is formed from the end in the transport direction of the recording medium P as compared with the initial image forming operation.

After the recording medium P is sent out from the pair of timing rollers 32, the toner image is transferred onto the second side or back side of the recording medium P as the recording medium P passes the secondary transfer roller 20. The toner image on the back side is fixed onto the recording medium P in the fixing device 34, and thereafter, the recording medium P is output onto the output tray 45 via the post-fixation conveyance path 35, the output path 36, and the pair of output rollers 37 accordingly. It is to be noted that in order to enhance efficiency of double sided printing multiple recording media P can be delivered at the same time in the conveyance path 31.

In order to facilitate an understanding of the novel features of the present disclosure, as a comparison a description is provided of a conventional detection method for detection of changes in the traveling speed of the intermediate transfer belt.

In order to detect changes in the traveling speed of the intermediate transfer belt, in one example, a plurality of test patterns is formed on the intermediate transfer belt along the traveling direction of the intermediate transfer belt, and the time at which each test pattern passes is detected so as to obtain the traveling speed of the intermediate transfer belt. In order to prevent the test images from getting transferred undesirably onto a recording medium, the test images are transferred onto an outside of a sheet contact region of the intermediate transfer belt in the width direction.

However, when transferring the test patterns outside of the sheet contact region of the intermediate transfer belt in the width direction, the width of the intermediate transfer belt needs to be widened to accommodate the test images, hence resulting in an increase in the size of the image forming apparatus.

In view of the above, there is thus an unsolved need for an image forming apparatus capable of detecting changes in a traveling speed of an intermediate transfer member without increasing the width of the intermediate transfer member in the width direction thereof.

Figure 3A:
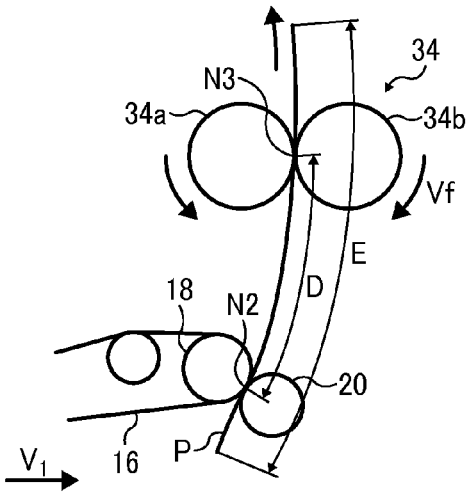
FIG. 3A is a schematic diagram illustrating a secondary transfer portion of the image forming apparatus when a distance D between a secondary transfer nip (also referred to as secondary transfer portion) N2 and a fixing nip N3 is shorter than a length of a recording medium P.
Figure 3B:
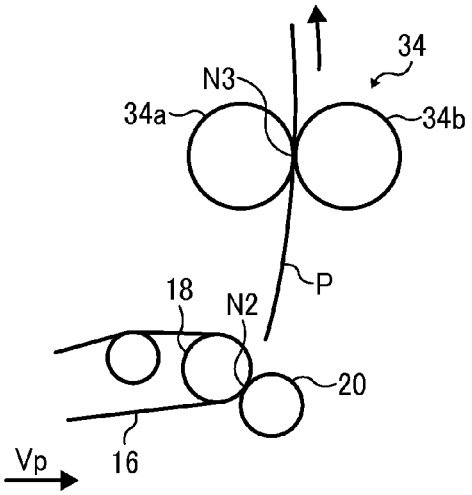
FIG. 3B is a schematic diagram illustrating the secondary transfer portion when a trailing edge of the recording medium P exits the secondary transfer nip N2.

As illustrated in FIG. 3A, in a case in which a distance D in the transport direction of the recording medium P between the secondary transfer nip (the secondary transfer portion) N2 defined by the intermediate transfer belt 16 and the secondary transfer roller 20 contacting each other and the fixing nip (fixing portion) N3 defined by the fixing roller 34*a* and the pressing roller 34*b* is shorter than a length E of the recording medium P, the recording medium P can be transported while the recording medium P is held by both the secondary transfer nip N2 and the fixing nip N3. Since the fixing roller 43*a* has a heat source inside thereof, the diameter of the fixing roller 34*a* changes easily due to thermal expansion. As a result, a transport speed at which the recording medium P is transported at the fixing nip N3 is not stable. In this case, the recording medium P may be transported with slack between the secondary transfer nip N2 and the fixing nip N3 or the recording medium P may be transported while being tensioned between the secondary transfer nip N2 and the fixing nip N3. If the transport speed is set such that the recording medium P is always slack, the toner image transferred on the recording medium P may contact the guide and so forth, hence disturbing the toner image. Therefore, it is necessary to allow the case in which the recording medium P is tensioned between the secondary transfer nip N2 and the fixing nip N3.

However, when transporting the recording medium P while being tensioned, shock jitter occurs at the primary transfer nip at which the photoconductor 2K faces the primary transfer roller 19. A traveling speed $V_1$ at which the intermediate transfer belt 16 travels at the secondary transfer nip N2 is substantially slower than a rotation speed Vf of the fixing roller 34*a*. In addition, a transport force to transport the recording medium P at the fixing nip N3 is significantly greater than a transport force to transport the recording medium P at the secondary transfer nip N2. As a result, the recording medium P interposed in the secondary transfer nip N2 is pulled up toward the fixing nip N3, and the tension of the recording medium P causes the traveling speed $V_1$ of the intermediate transfer belt 16 to become greater than a target traveling speed Vp.

Figure 4:
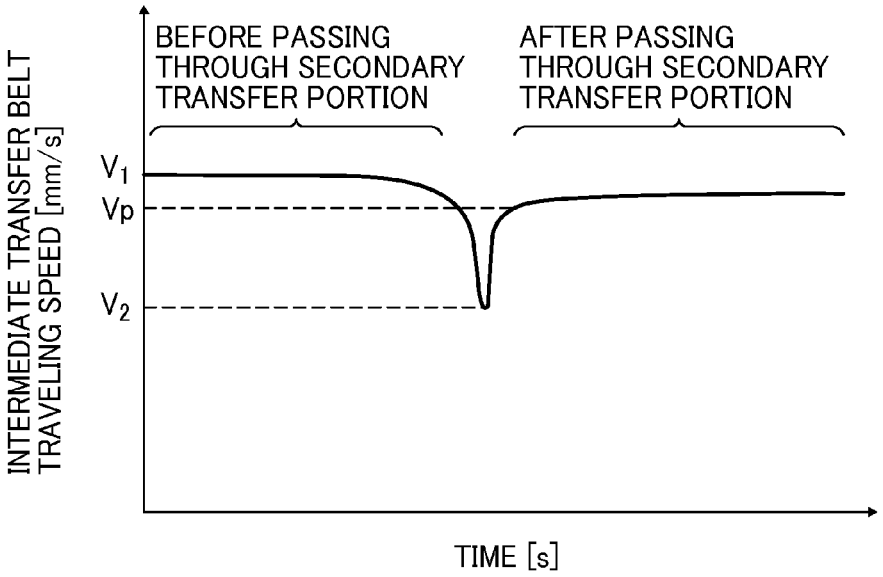
FIG. 4 is a graph showing changes in a traveling speed of an intermediate transfer belt.

Furthermore, as the recording medium P is transported and the trailing edge of the recording medium P passes through the secondary transfer nip N2, the recording medium P loses its tension and hence the traveling speed $V_1$ of the intermediate transfer belt 16 tries to return to the target traveling speed Vp, resulting in changes in the traveling speed of the intermediate transfer belt 16. The changes in the traveling speed occur instantly and generate shock. The traveling speed $V_1$ drops momentarily to a traveling speed $V_2$ as shown in FIG. 4.

At this time, if the toner image is transferred onto the intermediate transfer belt 16 from the photoconductor 2 at the primary transfer nip, this momentary drop in the traveling speed of the intermediate transfer belt 16 causes the toner image transferred at the primary transfer nip to shrink in the traveling direction of the intermediate transfer belt 16, which appears as a horizontal black band, resulting in image failure. Such an abnormal image appears on a recording medium P which is transported subsequent to the recording medium P with the trailing edge thereof passed through the secondary transfer nip. The abnormal image or shock jitter derived from sudden fluctuations of the traveling speed of the intermediate transfer belt 16 depends not only on the transport speed at the secondary transfer nip N2 and the fixing nip N3, but also on the thickness and stiffness of the recording medium P.

In view of the above, according to the present illustrative embodiment of the present disclosure, the traveling speed of the intermediate transfer belt 16 is detected.

Figure 5:
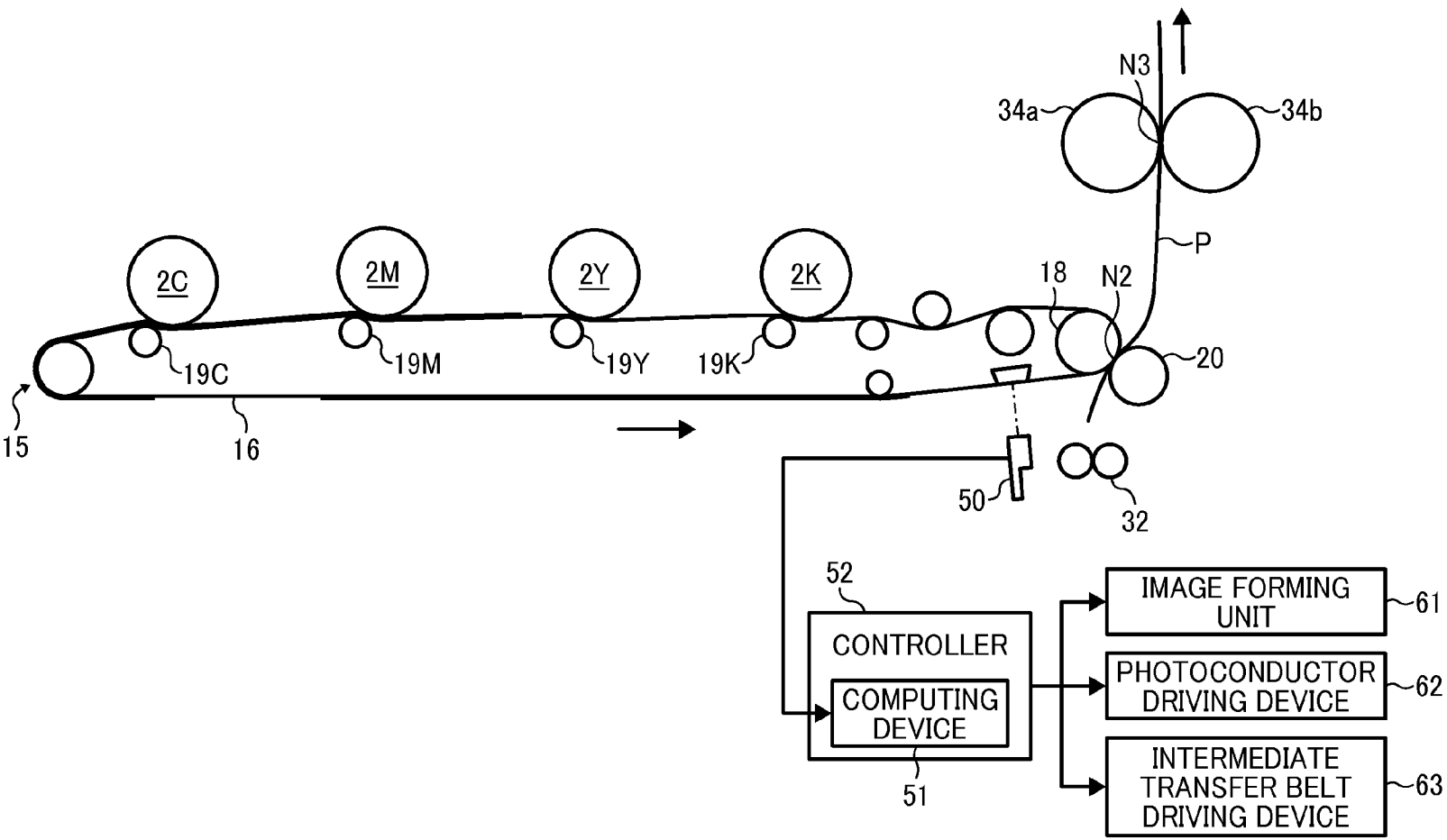
FIG. 5 is a schematic diagram illustrating a configuration of speed detection including an image detector and a controller.

More specifically, as illustrated in FIG. 5, the image forming apparatus 100 includes an image detector 50 and a computing device 51. The image detector 50 detects a test pattern serving as an image for adjustment. Based on detection information provided by the image detector 50, the computing device 51 calculates the speed of the intermediate transfer belt 16. The image detector 50 includes an optical detector disposed outside the loop formed by the intermediate transfer belt 16. The computing device 51 forms a part of a controller 52 such as a central processing unit (CPU) that controls overall operation of the image forming apparatus 100.

Figure 6A:
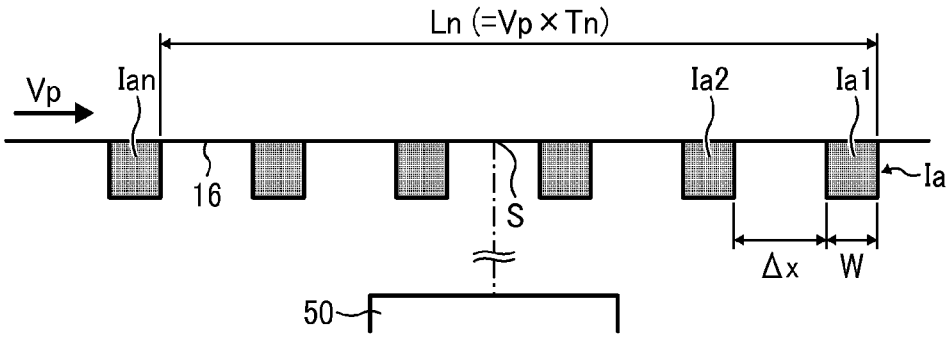
FIG. 6A through 6C are schematic diagrams illustrating test patterns transferred onto the intermediate transfer belt employed in the image forming apparatus.

As illustrated in FIG. 6A, a test pattern Ia having a predetermined width W (mm) is continuously formed on the photoconductor 2 at predetermined intervals Δx (mm). After development, the test pattern Ia is transferred onto the intermediate transfer belt 16. A number n of consecutive test patterns Ia are given references Ia1, Ia2, Ia3, . . . and Ian. The traveling speed Vp (mm/s) of the intermediate transfer belt 16 is obtained by Equation 1:

$$Vp=(W+\Delta x)\times(n-1)/Tn \quad \text{(Equation 1)}$$

Figure 6B:
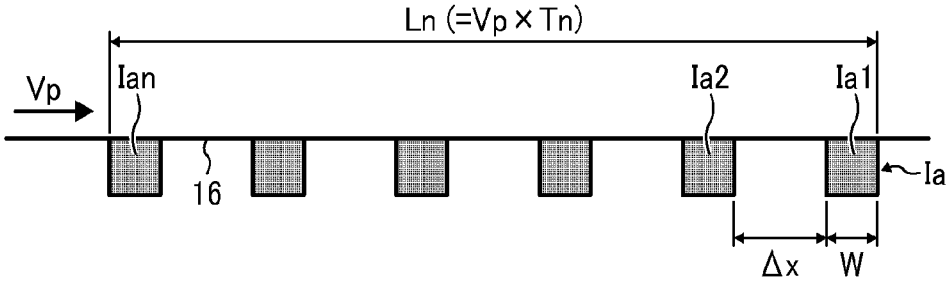
Figure 6C:
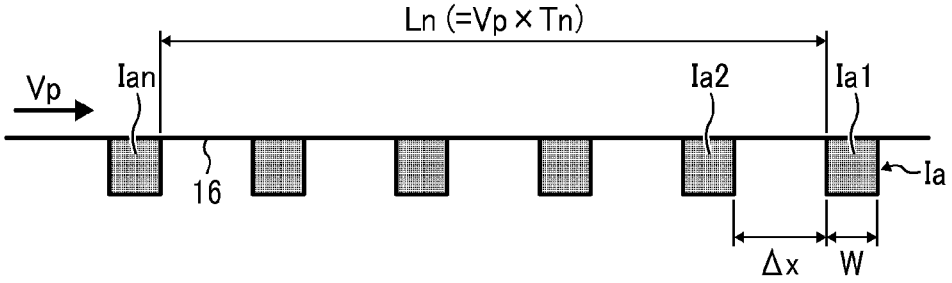

It is to be noted that the image detector 50 detects the test patterns on a predetermined detection cycle. Thus, the detection timing on the predetermined detection cycle does not necessarily coincide with the position of a front edge of a first test image Ia1 and the position of a front edge of the last test image Ian illustrated in FIG. 6A. However, the detection cycle is set shorter than a time during which the test image Ia passes the detection position. Thus, the test image can be detected at any position within a width W of the test image Ia. In this configuration, the maximum detection distance Ln (mm) of the test image Ia detected by the image detector 50 is in a range illustrated in FIG. 6B and the minimum detection distance thereof is in a range illustrated in FIG. 6C.

When the detection distance Ln is at its maximum and at its minimum, the largest value of the traveling speed Vp_max [mm/s] of the intermediate transfer belt 16 and the smallest value of the traveling speed Vp_min [mm/s] are expressed by Equation 2 and Equation 3 below.

$$Vp_\text{max}=\{(W+\Delta x)\times(n-1)+W\}/Tn \quad \text{(Equation 2)}$$

$$Vp_\text{min}=\{(W+\Delta x)\times(n-1)-W\}/Tn \quad \text{(Equation 3)}$$

Accordingly, a largest detection error (Vp_max-Vp_min) can be obtained by Equation 4.

$$Vp_\text{max}-Vp_\text{min}=2W/Tn \quad \text{(Equation 4)}$$

In order to minimize the largest detection error and increase the detection accuracy of the traveling speed of the intermediate transfer belt 16, the detection time Tn is increased or the width W of the test image Ia is reduced. However, if the width W of the test image Ia is reduced too much, the test image Ia may pass the detection position without getting detected during the detection cycle ts [s] of the image detector 50. Thus, the following relation (Equation 5) needs to be satisfied:

W>ts×Vu, where Vu is a design upper limit value of the traveling speed of the intermediate transfer belt 16.

Therefore, by reducing the width W of the test image Ia or increasing the detection time Tn within a rage in which Equation 5 is satisfied, the largest detection error can be reduced as much as possible and the detection accuracy of the traveling speed of the intermediate transfer belt 16 can be enhanced.

The test image Ia is transferred onto the intermediate transfer belt 16. When the transfer position thereof is set outside the sheet contact region on the intermediate transfer belt 16 in the width direction such as in the conventional image forming apparatus, the width of the intermediate transfer belt 16 increases, hence increasing the size of the image forming apparatus as a whole.

Figure 7:
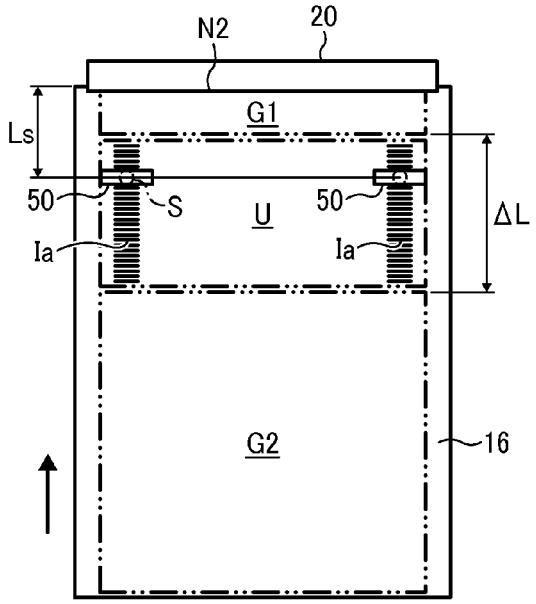
FIG. 7 is a schematic diagram illustrating a position of the image detector.

In view of the above, according to an illustrative embodiment of the present disclosure, as illustrated in FIG. 7, the test image Ia is transferred in a region U between an image transfer region G1 on the intermediate transfer belt 16 and a successive image transfer region G2. With this configuration, the width of the intermediate transfer belt 16 does not need to be widened, thereby making the image forming apparatus as a whole as compact as is usually desired. According to the present illustrative embodiment, the image transfer regions G1 and G2 on the intermediate transfer belt 16 coincide with the sheet contact region or the recording-medium contact region at which the recording medium contacts the intermediate transfer belt 16 at the secondary transfer nip N2. Therefore, the space between the image transfer regions G1 and G2 on the intermediate transfer belt 16 coincides with the space between successive recording media sheets continuously transported. For the sake of convenience, the region U between the image transfer regions G1 and G2 is hereinafter referred to as a sheet interval U.

As described above, since the test image Ia is transferred in the sheet interval U on the intermediate transfer belt 16, the time Tn which is a time required for the image detector 50 to detect the test image Ia needs to be shorter than the time required for the sheet interval U to pass the detection position S. Thus, the following relation (Equation 6) needs to be satisfied:

Tn<ΔL/Vb, where ΔL is the sheet interval U (the space between the previous and the successive recording medium contact regions) and Vb is a design lower limit value of the traveling speed of the intermediate transfer belt 16.

The above calculation method is one example and is not limited thereto. The traveling speed of the intermediate transfer belt 16 can be monitored more finely or at a smaller time unit by detecting continuously the detection regions of the test images one after another and calculating the traveling speed based on multiple detection information.

According to the one or more embodiments, changes in the traveling speed of the intermediate transfer belt 16 are detected before and after the trailing edge of the recording medium passes through the secondary transfer nip. Thus, the image detector 50 needs to detect the test pattern before and after the trailing edge of the recording medium passes through the secondary transfer nip N2. In view of the above, the image detector 50 is disposed at a position described below.

Figure 8A:
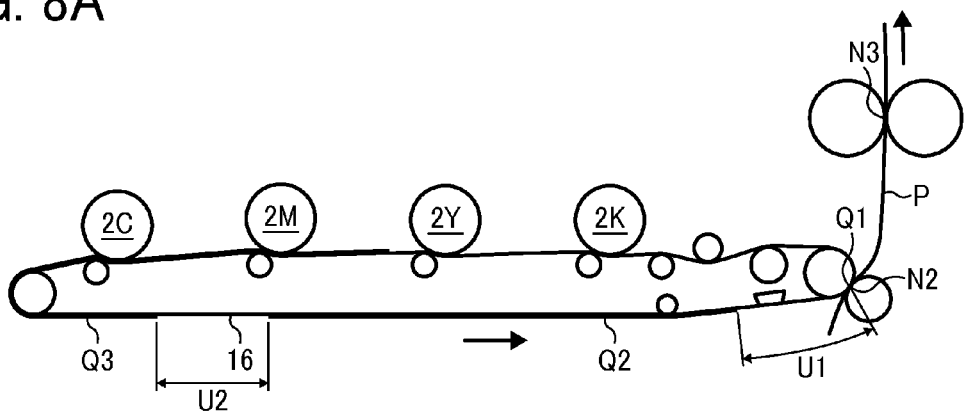
FIG. 8A is a schematic diagram illustrating devices associated with transfer operation when printing on A4 paper.

FIG. 8A illustrates transfer operation using an A4-size recording medium. In FIG. 8A, toner images Q1, Q2, and Q3 have a size of A4 and are transferred on the intermediate transfer belt 16 at predetermined sheet intervals U1 and U2. In this case, immediately before and after the trailing edge of the recording medium P passes through the secondary transfer nip N2, there are two sheet intervals U, that is, the sheet intervals U1 and U2 on the intermediate transfer belt 16. Thus, the image detector 50 needs to be disposed at such a position at which the image detector 50 can detect the pattern image Ia at at least one of the sheet intervals U1 and U2.

Figure 8B:
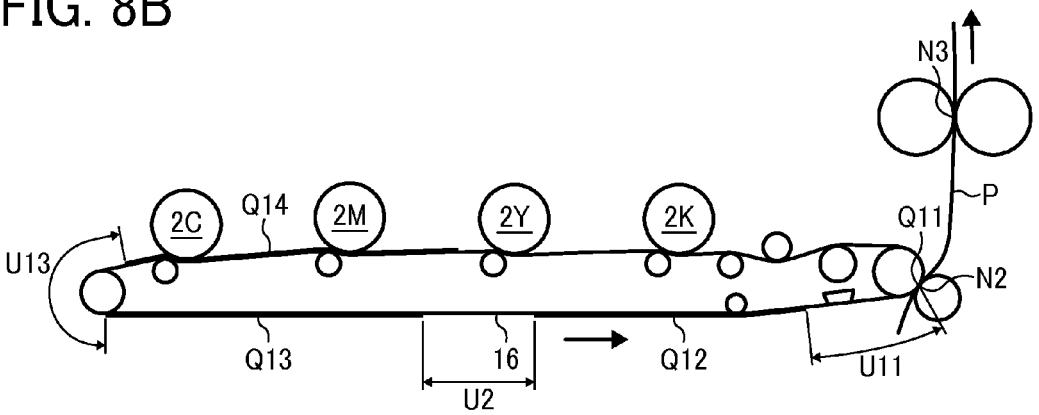
FIG. 8B is a schematic diagram illustrating the devices associated with transfer operation when printing on B5 paper.

FIG. 8B illustrates transfer operation using a B5-size recording medium. In FIG. 8B, toner images Q11, Q12, Q13, and Q14 have a size of B5 and are transferred on the intermediate transfer belt 16 at predetermined sheet intervals U11, U12, and U13. In this case, immediately before and after the trailing edge of the recording medium P passes through the secondary transfer nip N2, there are three sheet intervals U, that is, the sheet intervals U11, U12, and U13 on the intermediate transfer belt 16. Thus, the image detector 50 needs to be disposed at such a position at which the image detector 50 can detect the pattern image Ia at at least one of the sheet intervals U11, U12, and U13.

As described above, the number of sheet intervals and the positions of sheet intervals on the intermediate transfer belt 16 differ between the A4-size recording medium and the B5-recording medium. However, even when the size of the recording medium P is different, at least a portion of the intermediate transfer belt 16 at the sheet intervals U1 and U11 immediately before the secondary transfer nip N2 coincides. Therefore, the image detector 50 needs to be disposed at the common region.

Figure 12:
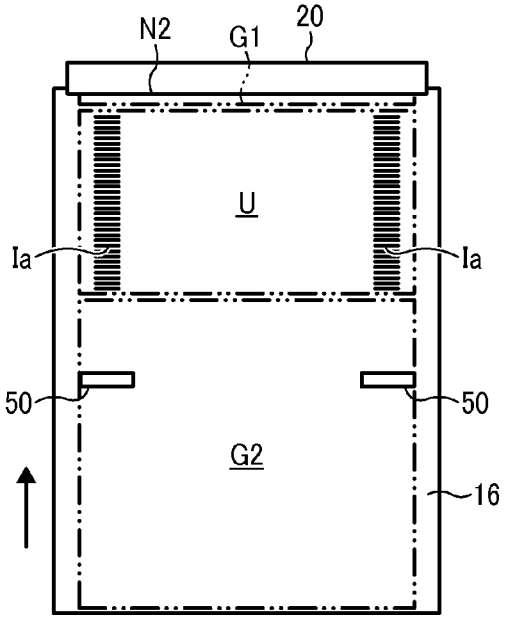
FIG. 12 is a schematic diagram illustrating a comparative example of the position of the image detector.

Furthermore, as illustrated in FIG. 12, the image detector 50 needs to be disposed such that the image detector 50 stays within the sheet interval U immediately before the trailing edge of the preceding image transfer region G arrives at the secondary transfer nip N2, that is, immediately before the trailing edge of the recording medium P passes through the secondary transfer nip N2.

In view of the above, according to the illustrative embodiment with reference to FIG. 7, a distance Ls between the detection position S at which the image detector 50 detects the image on the intermediate transfer belt 16 and the secondary transfer nip N2 is shorter than the distance Δ of the sheet interval U in the traveling direction of the intermediate transfer belt 16. With this configuration, the image detector 50 can detect the test image Ia at the sheet interval U on the intermediate transfer belt 16 immediately before and after the trailing edge of the recording medium P passes through the secondary transfer nip N2.

According to the illustrative embodiments, the image detector 50 is disposed at both ends of the intermediate transfer belt 16 in the width direction thereof. In other words, the total of two image detectors 50 is disposed. Alternatively, only one image detector 50 may be disposed.

The distance ΔL of the sheet interval U may be changeable depending on the size of recording medium and print modes such as a full-color print mode and a monochrome print mode. Thus, in some embodiments, the image detector 50 is disposed at a position that can accommodate all different distances of the sheet intervals U that are changeable.

It is to be noted that the same effect can still be achieved when the position of the image detector 50 accommodates at least one distance of the sheet interval U. Therefore, in some embodiments, the distance Ls from the detection position S to the secondary transfer nip N2 in the traveling direction of the intermediate transfer belt 16 is configured shorter than the smallest distance ΔL_min among all the changeable sheet intervals U.

Figure 9A:
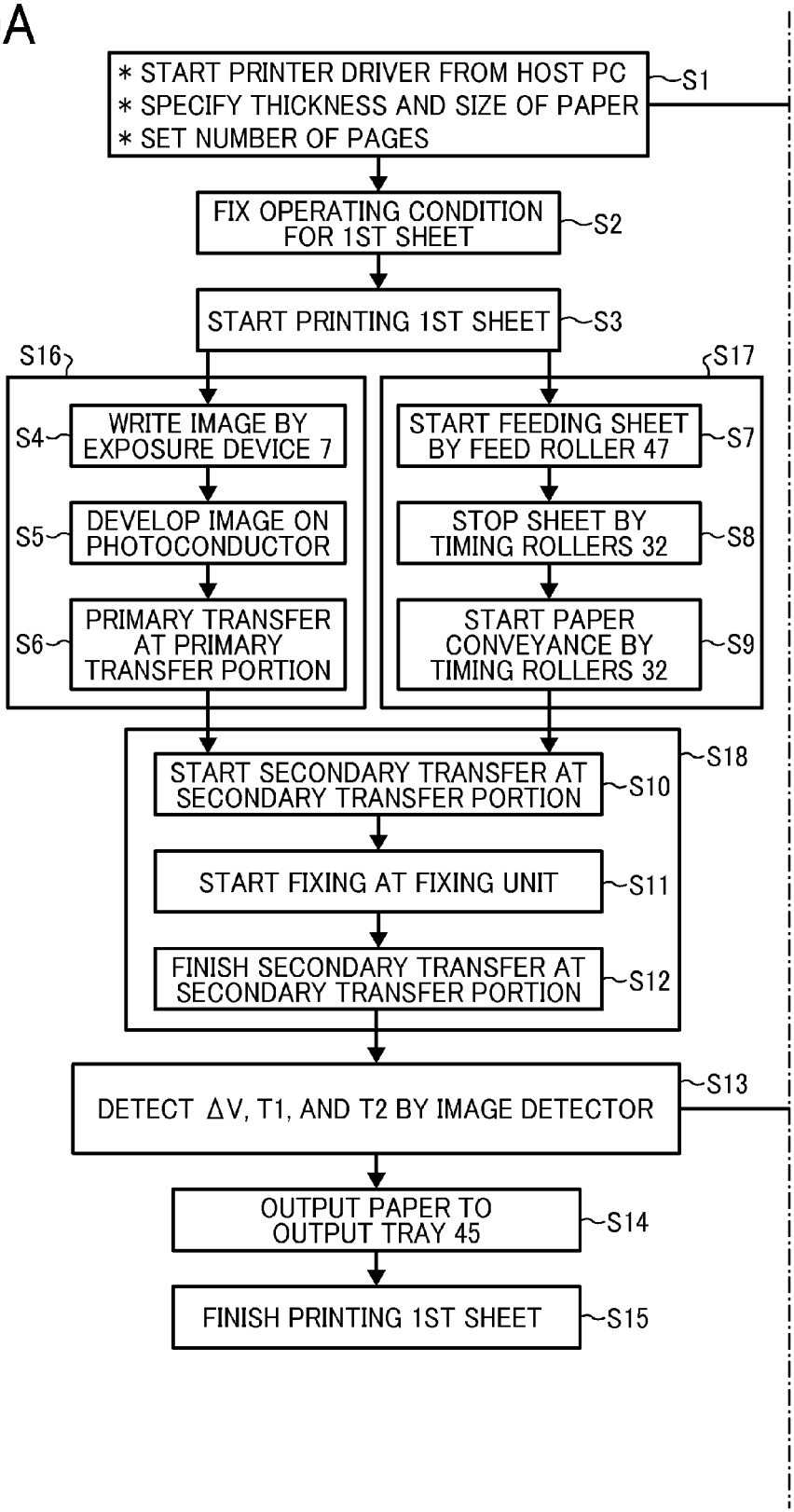
FIGS. 9A and 9B show a flowchart showing steps in printing operation according to an illustrative embodiment of the present disclosure.
Figure 9B:
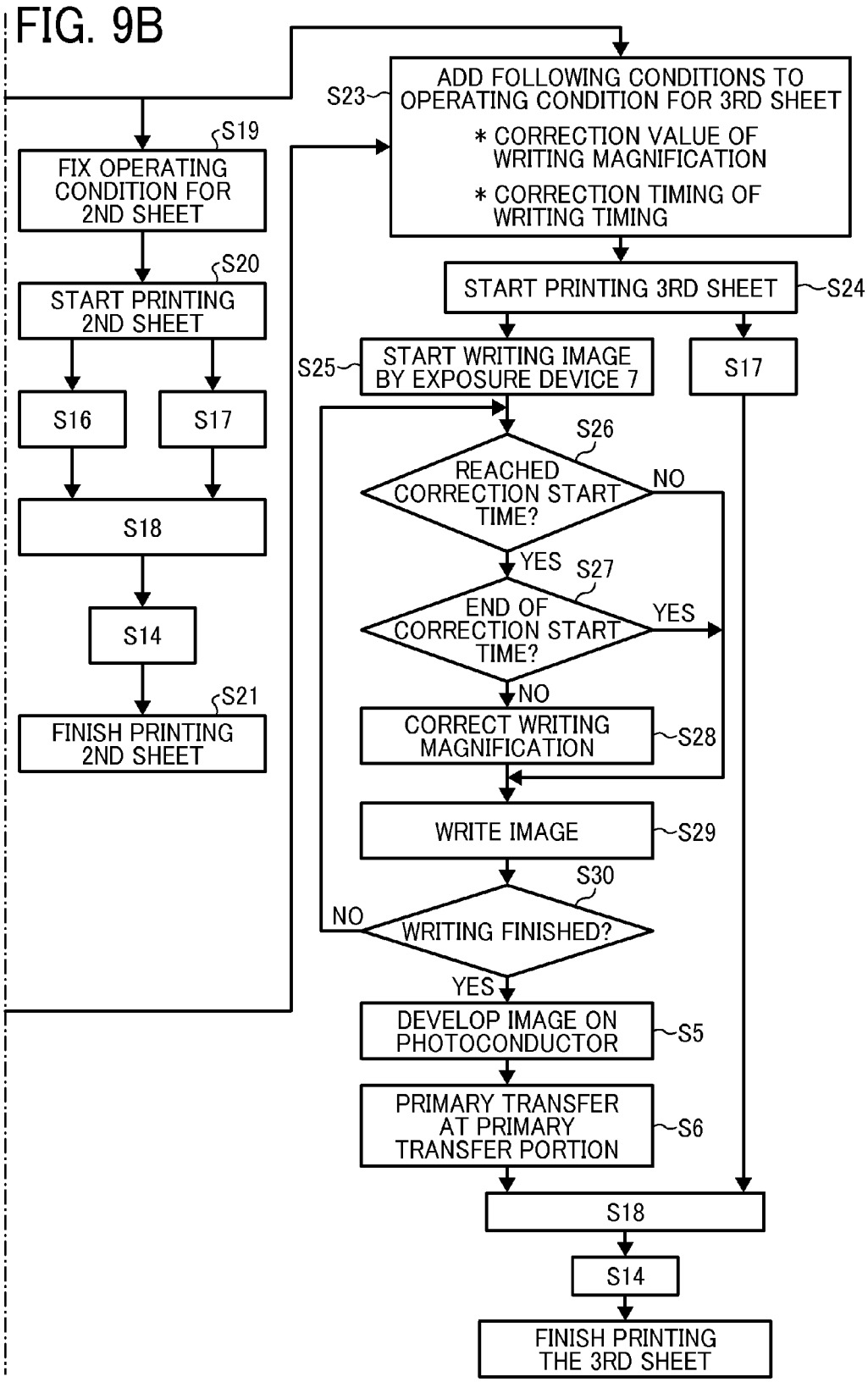

FIG. 9 is a flowchart showing steps for printing operation according to an illustrative embodiment of the present disclosure.

With reference to FIG. 9, a description is provided of continuous printing operation for the first through the third sheets of the recording media.

First, at step S1, a user activates a printer driver via a personal computer and selects a thickness and a size of the recording medium P. For example, the user instructs printing operation for three sheets of recording media. Subsequently, at step S2, operating conditions such as a speed of rotation of each driver and a magnification of writing are fixed, and then the printing operation starts at step S3.

The printing operation splits into image forming operation at step S16 and sheet conveyance operation at step S17. More specifically, at step S16, an image is written by the exposure device 7, and a toner image is formed on the photoconductor 2. Subsequently, the toner image on the photoconductor 2 is primarily transferred onto the intermediate transfer belt 16 by the primary transfer roller 19. At step S17, in the sheet conveyance operation, the recording medium P on the paper tray 30 is supplied by the feed roller 47. Subsequently, at step S8, the recording medium P is stopped temporarily by the pair of timing rollers 32. At step S9, conveyance of the recording medium P starts again at a timing at which the recording medium P is aligned with the toner image. Subsequently, the toner image is transferred secondarily onto the recording medium P at step S10 and fixed at step S11.

Subsequently, when the secondary transfer is completed at step S12, that is, when the trailing edge of the recording medium P passes through the secondary transfer nip N2, the speed of the intermediate transfer belt 16 changes. Based on the detection information provided by the image detector 50 which has detected the test image Ia on the intermediate transfer belt 16, the amount of speed fluctuation ΔV in the speed of the intermediate transfer belt 16 is calculated while detecting a time T1 (hereinafter referred to as start time T1) and a time T2 (hereinafter referred to as finish time T2), where T1 is a time from which the image writing is started at step S4 to a time at which the fluctuation of the speed starts, and T2 is a time from which the image writing is started to a time at which the fluctuation of the speed stops. After the fixing process, the recording medium P is output onto the output tray at step S14, and the printing for the first sheet of the recording medium is finished at step S15.

The amount of speed fluctuation ΔV detected at step S13, the start time T1, and the finish time T2 are fed to the operating conditions for the third sheet at step S23. As for the second sheet, the operation for the second sheet at step S19 takes place earlier than step S13. Thus, there is not enough time to feed back the amount of speed fluctuation ΔV, the start time T1, and the finish time T2, and hence the amount of speed fluctuation ΔV at step S13, the start time T1, and the finish time T2 are fed to the operating conditions for the third sheet and beyond.

The sheet conveyance operation at step S17 for the third sheet after printing starts at step S24 is the same as the operation for the first sheet. However, the image writing in the image forming operation is different from the first sheet. In order to correct shrinkage in the toner image at the primary transfer nip when the fluctuation of the speed of the intermediate transfer belt 16 detected on the first sheet occurs, a correction amount k of the image on the third sheet is obtained by the following equation (Equation 7).

$$k=(Vp+\Delta V)/Vp, \text{ where } Vp \text{ is the target speed of the belt.} \quad \text{(Equation 7)}$$

The magnification of the image is corrected using Equation 7 at step S28 only at a time corresponding to the fluctuation of the speed on the third sheet, that is, when a correction start time arrives at step S26 and when the correction start time is not completed at step S27.

There are three example correction methods. In the first example method, the controller 52 controls the speed of image formation of an image forming unit 61 (shown in FIG. 5) so as to change the intervals for writing the image on the photoconductor 2. The exposure device 7 projects laser light in accordance with image data. A light emission interval is increased by k times only at a time at which correction is performed. With this configuration, the magnification of the image can be changed at a designated place.

In the second example method, the controller 52 controls a photoconductor driving device 62 (shown in FIG. 5) to increase the rotation speed (surface moving speed) $V_0$ of the photoconductor 2 by k times only at a specific timing. With this configuration, the image on the photoconductor 2 is stretched by k times, hence achieving the same effects.

In the third example, the controller 52 controls an intermediate transfer belt driving device 63 to change the traveling speed of the intermediate transfer belt 16 only at a specific timing so that the intermediate transfer belt 63 travels at the target speed Vp. In some embodiments, a combination of two or more correction methods can be employed.

A correction start timing T in the first and the second example correction methods is obtained based on a time from the previous start of exposure to the successive start of exposure (an image length Lg in the sub-scanning direction+the sheet interval ΔL), a distance La from the exposure position to the primary transfer nip, a number t of pages on which an image may be present from the exposure position to the secondary transfer nip, and the rotation speed $V_0$ of the photoconductor 2. The correction start timing T is expressed by Equation 8 below.

$$T=T1-\{La+t(L+\Delta L)\}/V_0 \quad \text{(Equation 8)}$$

The third method is expressed by Equation 9 below.

$$T=T1-t(L+\Delta L)/V_0 \quad \text{(Equation 9)}$$

It is to be noted that the number of pages (t) for each of colors yellow, magenta, and cyan is two (t=2). The number of pages (t) for black is three (t=3). Therefore, T may be different for each color.

With this configuration, image correction is performed, and shock jitter is prevented. It is to be noted that this procedure can be carried out every time the recording medium P passes through the secondary transfer nip N2 (per sheet). However, if the traveling speed of the intermediate transfer belt does not change for each sheet, changes in the speed may be calculated by detecting only the test image transferred in the sheet interval U between the first sheet and the second sheet in the continuous printing operation. In this case, there is no need to transfer the test image in the sheet interval subsequent to the second sheet. Thus, consumption of toner is reduced.

There is a case in which the fluctuation of the speed of the intermediate transfer belt increases or decreases for each sheet. The diameter of the fixing roller 34*a* changes due to fluctuation in the amount of heat of the fixing roller 34*a*. As a result, the transport speed at which the recording medium P is transported at the fixing nip N3 is not stable. In such a case, the speed is detected for each sheet, and the magnification and timing are adjusted assuming that the speed fluctuation and the difference in the occurrence timing of the speed fluctuation are the same for each sheet, thereby preventing more stably the shock jitter. In order to stabilize the speed of the fixing roller 34*a* (the transport speed of the recording medium), the detection result may be reflected upon the rotation speed of a fixing device driving device.

Figure 10:
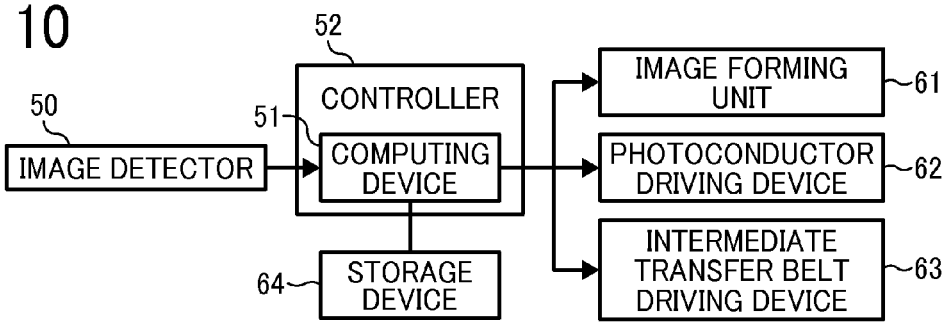
FIG. 10 is a block diagram showing another example of a control.

The information on the speed fluctuation which occurred when the first sheet passed through the secondary transfer nip N2 is fed to the printing operation at least for the second sheet and beyond. In view of the above, as illustrated in FIG. 10, the image forming apparatus 100 includes a storage device 64 to store results of calculation by the computing device 51. The amount of speed fluctuation ΔV detected at step S13, the start time T1, and the finish time T2 are stored relative to the thickness and the size of the recording medium P specified at step S1 of FIG. 9 as needed. With this configuration, during printing immediately after turning on the power, magnification of the image can be corrected based on the past print information stored in the storage device 64. Thus, even when continuous printing is less frequent in actual use, the shock jitter can be prevented for the very first sheet at the initial printing.

Figure 11:
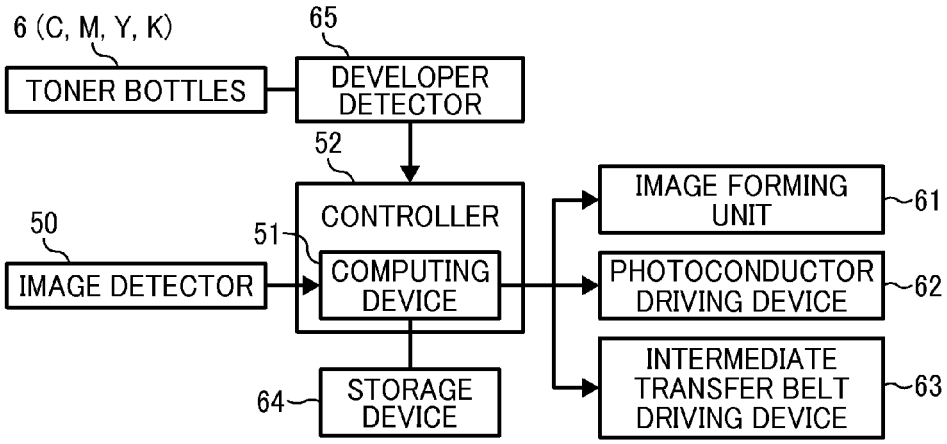
FIG. 11 is a block diagram showing still another example of a control.

As illustrated in FIG. 11, the image forming apparatus includes a developer detector 65 that detects an amount of toner in the toner bottles 6. Based on the detection information provided by the developer detector 65, the controller 52 determines whether or not to form a test image. With this configuration, in a case in which the amount of remaining toner in the toner bottles 6 becomes scarce, the test image is not formed, thereby reducing consumption of toner. Furthermore, even when the test image is not formed, correction can be performed by using the past information stored in the storage device 64.

Alternatively, based on the detection information provided by the developer detector 65, the controller 52 may select the toner bottle 6 that is used for forming the test image. With this configuration, in a case in which the remaining toner in one of the toner bottles 6 becomes scarce, the toner in the toner bottle 6 having a relatively large amount of remaining toner is used to form the test image.

According to an aspect of this disclosure, the present invention is employed in the image forming apparatus. The image forming apparatus includes, but is not limited to, an electrophotographic image forming apparatus, a copier, a printer, a facsimile machine, and a multifunctional peripheral.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer to bear an image on a surface thereof;

an image forming unit to form the image including a test image on the image bearer;

an intermediate transfer member formed into an endless loop and disposed opposite the image bearer at a primary transfer portion at which the image is transferred from the image bearer onto the intermediate transfer member, the intermediate transfer member to travel in a traveling direction;

a secondary transfer member to contact the intermediate transfer member at a secondary transfer portion to transfer secondarily the image from the intermediate transfer member onto a recording medium;

an image detector to detect at a detection position a test image on the intermediate transfer member between the primary transfer portion and the secondary transfer portion in the traveling direction;

a computing device to calculate a traveling speed of the intermediate transfer member based on detection information provided by the image detector; and a conveyor device to continuously transport to the secondary transfer portion a plurality of recording media one by one at a predetermined interval between successive recording media, the image forming unit forming the test image at a space between successive recording medium contact regions of the intermediate transfer member at which the recording medium contacts the intermediate transfer member, and a travel distance of the intermediate transfer member from the detection position on the intermediate transfer member to the secondary transfer portion in the traveling direction being shorter than the space between the successive recording medium contact regions.

2. The image forming apparatus according to claim 1, wherein the predetermined interval between the successive recording media being conveyed is changeable, and the travel distance of the intermediate transfer member from the detection position to the secondary transfer portion is shorter than a space between the recording medium contact regions corresponding to a smallest interval among changeable intervals.

3. The image forming apparatus according to claim 1, further comprising a controller operatively connected to the image forming unit, to adjust an image forming speed of the image forming unit based on a calculation result provided by the computing device.

4. The image forming apparatus according to claim 1, further comprising a controller operatively connected to the image bearer, to adjust a surface moving speed of the image bearer based on a calculation result provided by the computing device.

5. The image forming apparatus according to claim 1, further comprising a controller operatively connected to the intermediate transfer member, to adjust the traveling speed of the intermediate transfer member based on a calculation result provided by the computing device.

6. The image forming apparatus according to claim 1, wherein the image detector detects the test image formed at the space between the successive recording medium contact regions of the intermediate transfer member corresponding to an interval between a previous and a subsequent recording medium, and the computing device calculates the traveling speed of the intermediate transfer member based on the detection information provided by the image detector.

7. The image forming apparatus according to claim 1, wherein the computing device calculates the traveling speed of the intermediate transfer member based on multiple detection information provided by the image detector.

8. The image forming apparatus according to claim 1, further comprising:

a fixing device to fix the image on the recording medium while transporting the recording medium onto which the image is transferred; and a controller operatively connected to the fixing device to adjust a transport speed of the fixing device based on a calculation result provided by the computing device.

9. The image forming apparatus according to claim 1, further comprising a storage device to store a calculation result provided by the computing device.

10. The image forming apparatus according to claim 1, further comprising:

a developing agent container to store a developing agent to develop the image;

a developing agent detector to detect an amount of developing agent in the developing agent container; and a controller operatively connected to the developing agent detector to determine whether or not to form the test image based on detection information provided by the developing agent detector.

11. The image forming apparatus according to claim 1, further comprising a plurality of developing agent containers to store developing agents to develop the image;

a developing agent detector to detect an amount of developing agent in the developing agent containers; and a controller operatively connected to the developing agent detector to determine which developing agent to use to form the test image based on detection information provided by the developing agent detector.

12. The image forming apparatus according to claim 1, further comprising a combination of at least two of a copying device, a facsimile machine, a printer, and an inkjet recording device.

13. An image forming apparatus, comprising:

a belt to bear an image on a surface thereof;

a transfer device to transfer the image from the belt onto a recording medium at a transfer portion; and a test image detector to detect at a detection position a test image formed at a space between successive recording media on the belt, a distance on the belt from the detection position to the transfer portion being shorter than the space between successive recording media on the belt.

14. The image forming apparatus according to claim 13, further comprising a photoconductor on which the image is formed, wherein the belt is an intermediate transfer belt onto which the image is transferred from the photoconductor.

* * * * *